US008632298B1

(12) United States Patent
Liang

(10) Patent No.: US 8,632,298 B1
(45) Date of Patent: Jan. 21, 2014

(54) TURBINE VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 431 days.

(21) Appl. No.: 13/052,318

(22) Filed: Mar. 21, 2011

(51) Int. Cl.
*F01D 5/08* (2006.01)

(52) U.S. Cl.
USPC ..... 415/115

(58) Field of Classification Search
USPC ..... 415/115, 116, 173.3, 174.3; 416/96 R, 416/95
See application file for complete search history.

(56) References Cited

U.S. PATENT DOCUMENTS

| | | | | |
|---|---|---|---|---|
| 4,017,213 | A * | 4/1977 | Przirembel | 416/97 A |
| 5,413,458 | A * | 5/1995 | Calderbank | 415/115 |
| 5,486,090 | A * | 1/1996 | Thompson et al. | 415/173.1 |
| 2008/0240927 | A1 * | 10/2008 | Bergander et al. | 416/97 R |
| 2009/0304520 | A1 * | 12/2009 | Brittingham et al. | 416/97 R |
| 2010/0239432 | A1 * | 9/2010 | Liang | 416/97 R |

* cited by examiner

*Primary Examiner* — Nathaniel Wiehe
*Assistant Examiner* — Eldon Brockman
(74) *Attorney, Agent, or Firm* — John Ryznic

(57) ABSTRACT

A turbine stator vane with an endwall cooling circuit that includes a first ten-pass serpentine flow cooling circuit and a second ten-pass serpentine flow cooling circuit. Each serpentine circuit is connected to cooling air feed holes supplied from an endwall impingement cavity, where cooling air serpentines along the leading edge section of the endwall, along the two mate faces, and then serpentines along the trailing edge section where the cooling air is discharged from exit holes spaced along the trailing edge side of the endwall.

13 Claims, 6 Drawing Sheets

TURBINE VANE WITH ENDWALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with endwall cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

In the prior art, vane endwall cooling is produced using backside impingement cooling in a middle region of the vane endwall with the spent impingement cooling air being discharged around the side edges of the endwall to provide for both cooling and sealing of the endwall. Discharge cooling air holes are drilled through the endwall and into an impingement cavity located at the middle of the vane endwall from both mate faces as well as from the endwall leading and trailing edges. The overall cooling effectiveness level for this design is very low, especially around the edges of the endwall. FIG. 1 shows a prior art stator vane with two airfoils extending between inner and outer diameter endwalls.

FIG. 2 shows a cross section top view of the endwall of FIG. 1 with the cooling circuit. Two airfoils 11 extend between endwalls and form an impingement cavity 12. Impingement cooling air holes 13 open into the impingement cavity to discharge impingement cooling air against the backside surface of the endwall. Leading edge cooling holes 14 discharge cooling air along the leading edge side of the endwall. Trailing edge cooling holes 15 discharge cooling air along the trailing edge side of the endwall. Mate face cooling holes 16 discharge cooling air from the two mate faces of the endwall. The cooling air holes 14-16 that provide cooling for the endwall are all connected to the impingement cavity 12 and discharge from all four edges of the endwall. The cooling air holes 14-16 are all straight cooling air holes that provide convection cooling only.

BRIEF SUMMARY OF THE INVENTION

An improvement for the entire vane endwall cooling design is achieved using the multiple impingement cooling circuit in combination with serpentine flow cooling circuits of the present invention for the vane endwall edges. The integration of the vane endwall cooling with the multiple pass serpentine flow cooling circuits along with backside impingement cooling of the endwall will allow for the total cooling air flow to be fully utilized. The multiple serpentine flow cooling circuits are formed by casting the serpentine cooling passages within the vane endwall edges to form an endwall edge cooling design which can be constructed in many forms.

The vane endwall of the present invention includes a impingement cavity connected to two separate serpentine flow cooling circuit that flow along the leading edge endwall first, then along the two mate face edges secondly, and then along the trailing edge endwall where the spent cooling air is then discharged out through a row of film cooling holes on the trailing edge side of the endwall. In one embodiment, the two serpentine flow circuits each include ten legs or channels to provide convection and impingement cooling for the endwall edges.

DETAILED DESCRIPTION OF THE INVENTION

The vane endwall cooling circuit of the present invention is intended to be used in a vane of an industrial gas turbine engine since industrial engines are designed to be operated for long periods of time compared to an aero engine. However, the vane endwall cooling circuit of the present invention could also be used in an aero engine vane.

Figure 3:
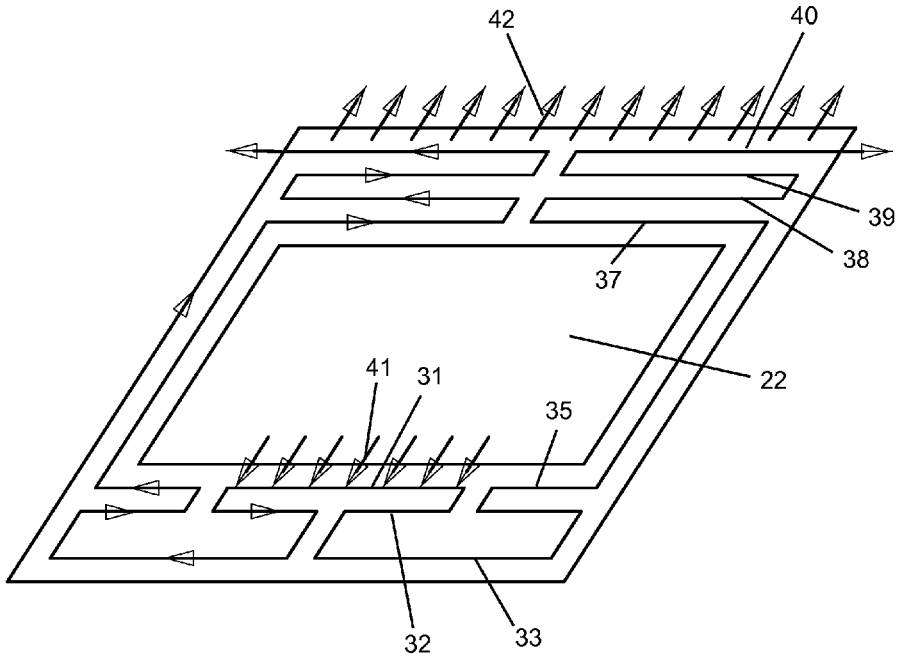
FIG. 3 shows a flow diagram from the top of the vane endwall cooling circuit of the present invention.

FIG. 3 shows a flow diagram of the endwall cooling circuit of the present invention. The vane includes two endwalls each with the same cooling circuit that is shown in FIG. 3. The endwall includes an impingement cavity 22 formed and supplied with cooling air like that in the prior art. A row of cooling air feed holes supply cooling air from the impingement cavity 22 to a cooling passage 31 located in the leading edge (L/E) section of the endwall adjacent to the impingement cavity 22. This cooling passage 31 forms the first leg for each of the two serpentine flow circuits.

The first leg 31 of the serpentine flow cooling circuit for the endwall flows toward the mate face sides and then turns into a second leg 32, then flows into a third leg 33 located along the L/E side edge of the endwall, and turns along the mate face edges and flows into a fifth leg 35 located adjacent to the L/E side of the impingement cavity 22. The first five legs 31-35 therefore provide cooling for the L/E side of the endwall first.

From the fifth leg 35, the cooling air then flows along a sixth leg 36 located along the mate face sides of the endwall. From the sixth leg 36, the cooling air then flows through four more legs 37-40 to provide cooling for the T/E side of the endwall. The seventh leg 37 flows toward the middle of the endwall, then turns into the eighth leg 38, which then turns into the ninth leg 39, and then finally turns into the last and tenth leg 40 located along the edge of the T/E side of the endwall. Rows of discharge cooling air holes are connected along the length of the two tenth legs 40 to discharge the cooling air. The end of the tenth leg 40 also opens onto the mate face side and discharges any remaining cooling air.

Figure 4:
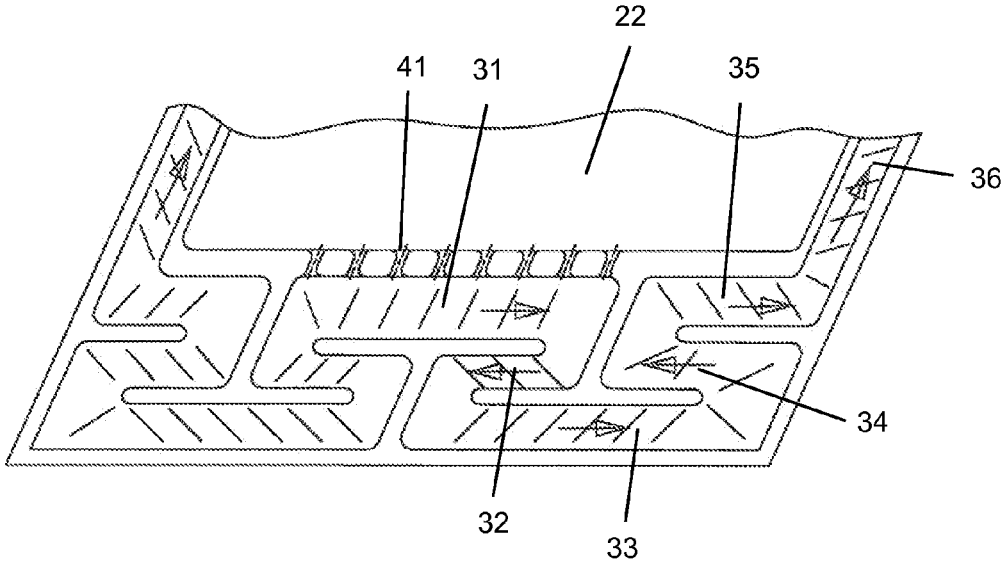
FIG. 4 shows a cross section view of the leading edge portion of the endwall cooling circuit of the present invention.

FIG. 4 shows a detailed view of the endwall cooling circuit for the L/E side of the endwall. The row of cooling air feed holes 41 are connected to the impingement cavity 22 to supply cooling air to the first legs 31 of the serpentine circuits. Trip strips are located in all of the channels or legs in order to increase the heat transfer coefficient of the cooling circuit. The ribs that separate and form the serpentine legs or channels also form surfaces for impingement cooling while the cooling air flows along the circuits.

Figure 5:
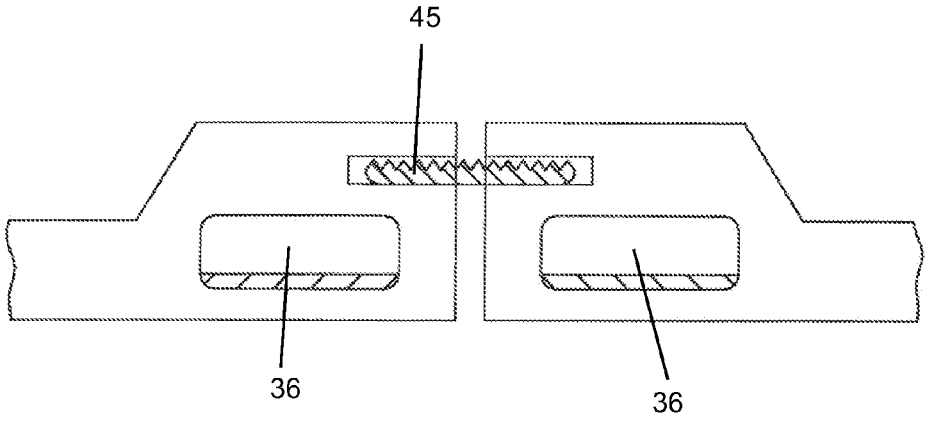
FIG. 5 shows a cross section side view of two adjacent endwalls with the mate face cooling legs of the present invention.

FIG. 5 shows a cross section view along the gap formed between adjacent endwalls with a mate face seal 45 secured within slots on each of the two mate faces. The two sixth legs 36 of the endwall serpentine flow cooling circuit of the present invention are shown in this section of the endwalls. Trip strips are shown on the hot side of the legs 36.

Figure 6:
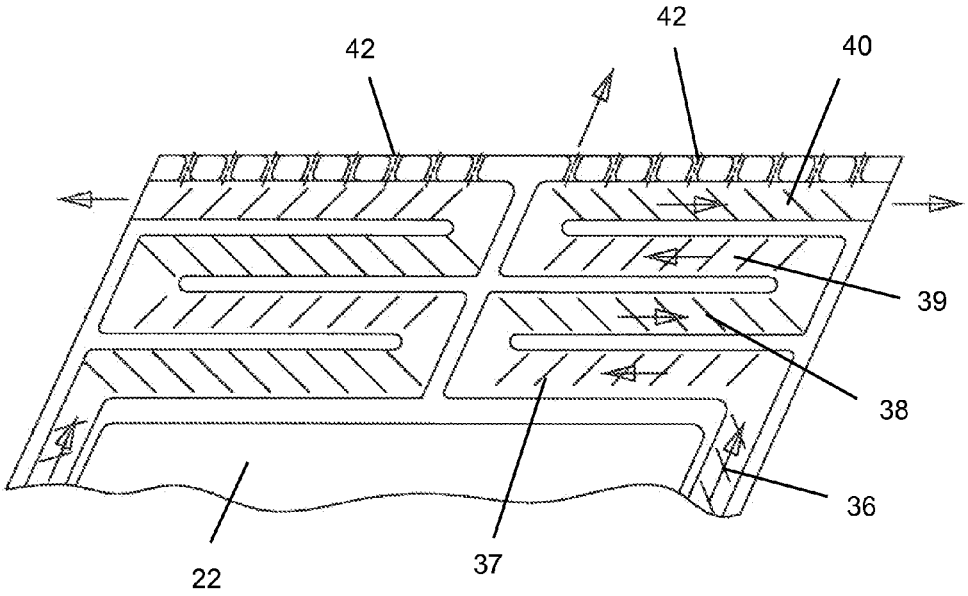
FIG. 6 shows a cross section view of the trailing edge portion of the endwall cooling circuit of the present invention.

FIG. 6 shows a detailed view of the endwall cooling circuit for the T/E side of the endwall. Cooling air from the two sixth legs 36 flows into the last four legs 37-40 of the serpentine circuit to provide cooling for the entire T/E side of the endwall. The rows of discharge cooling air holes 42 are spaced along the entire T/E side of the endwall. Ends of the two tenth legs 40 also discharge out from the mate face sides. Trip strips are shown in all of the legs in FIG. 6 to increase the heat transfer coefficient of the circuit.

Figure 1:
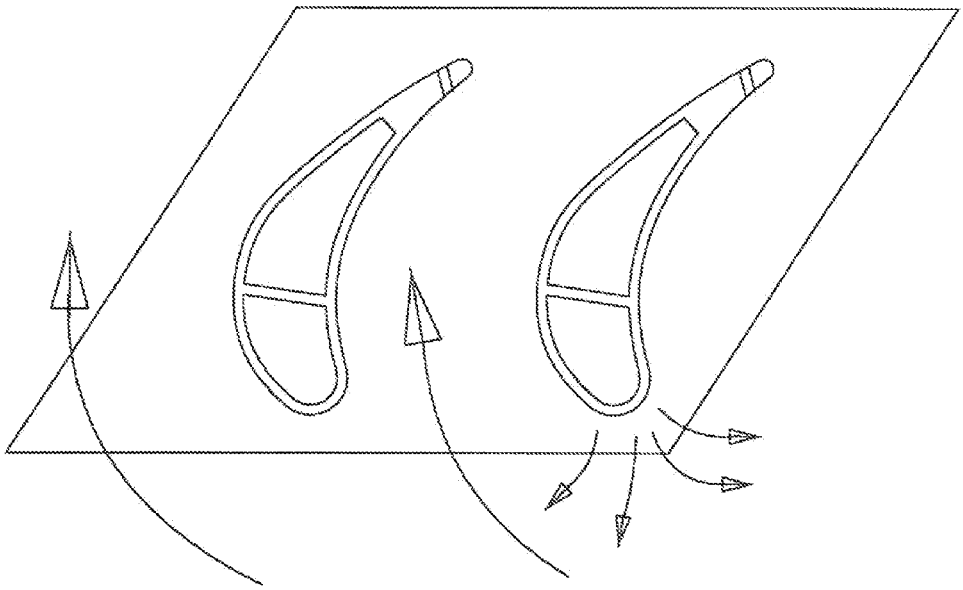
FIG 1 prior art
FIG. 1 shows a top view of a prior art stator vane with two airfoils extending from an endwall.
Figure 2:
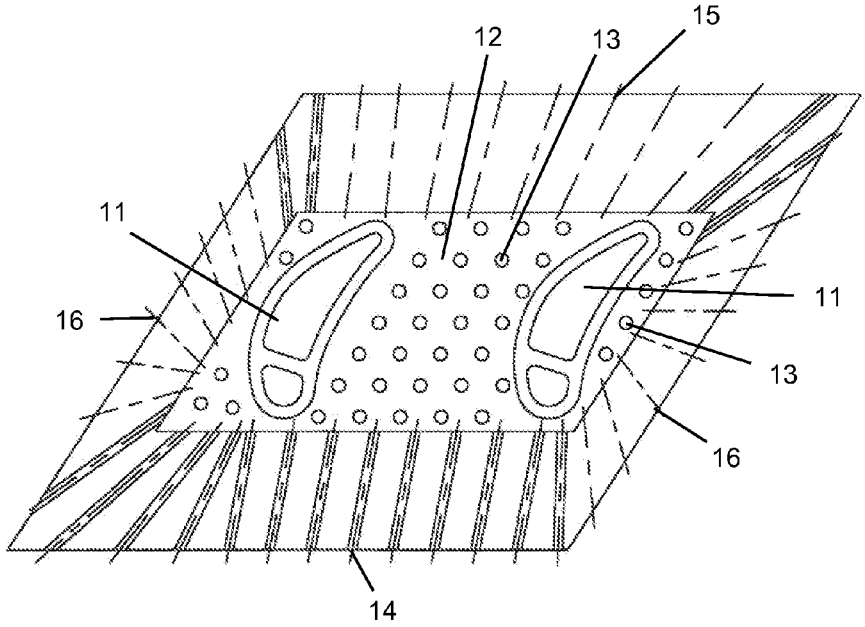
FIG 2 prior art
FIG. 2 shows a cross section view from the top of the FIG. 1 vane with the endwall cooling circuit.

The endwall cooling circuit of the present invention is formed into two multiple leg sections with one in the L/E side and the second in the T/E side. Each multiple leg section can be designed based on the airfoil endwall local external heat load in order to achieve a desired local metal temperature. The L/E section has five passes or channels with impingement cooling air flowing from the middle section of the airfoil toward the L/E edge of the endwall and then serpentines aft-ward toward the mate faces. With this design, a maximum use of the cooling air flow for a given airfoil inlet gas temperature and pressure profile is achieved for the vane endwall L/E region. Also, the serpentine flow cooling yields a higher internal convection cooling effectiveness than in the single pass straight cooling holes used in the prior art design of FIG. 2.

In the mate face edges of the endwall, two serpentine flow circuits are used. Spent cooling air is bled off from the L/E serpentine flow channel after cooling the vane endwall L/E section. The serpentine flow circuit directs the cooling air underneath of the mate face seal slot and then turns into the T/E serpentine channels to cool the T/E section of the endwall. Because the T/E section has a wider surface, two four-pass serpentine flow legs are used for the cooling of this section of the endwall. The spent cooling air from the two mate face channels or legs 36 flows into the two four-pass serpentine circuits formed in the T/E section of the endwall. Spent cooling air is gradually discharged through the discharge holes 42 spaced along the T/E edge of the endwall.

In operation, cooling air is supplied through a turbine vane carrier and metered through metering holes on an impingement ring and diffused into a cooling air compartment cavity. The cooling air is then metered through an impingement plate that is secured onto a backside surface of the vane endwall. The spent impingement cooling air within the impingement cavity then flows through the cooling air feed holes in the L/E section of the endwall and into the serpentine flow legs formed within the L/E section, then along the mate face legs 36, and then into the serpentine flow legs formed within the T/E section of the endwall to provide cooling. The spent cooling air is then discharged through the holes along the T/E side edge of the endwall and out the opening of the last leg on the mate face edges.

With the serpentine flow cooling circuit for the vane endwall of the present invention, a maximum usage of cooling air for a given vane endwall inlet gas temperature and pressure profile can be achieved. Also, all of the cooling air flow that enters the first leg also flows into the last leg so that all of the cooling air is used to cool the entire endwall surface. Optimum cooling flow utilization is achieved with this design.

I claim:

1. A turbine stator vane comprising:

an airfoil extending from an endwall;

the endwall having a leading edge section, two mate face sections, and a trailing edge section;

an impingement cooling air cavity formed on a backside of the endwall;

two multiple pass serpentine flow cooling circuits formed in the leading edge section of the endwall and connected to the impingement cooling air cavity through a row of cooling air feed holes;

two multiple pass serpentine flow cooling circuits formed in the trailing edge section of the endwall; and, two mate face cooling channels formed in the mate face sections connecting the multiple pass serpentine flow cooling circuits formed in the leading edge section to the multiple pass serpentine flow cooling circuits formed in the trailing edge section.

2. The turbine stator vane of claim 1, and further comprising:

the leading edge serpentine flow circuits both include five legs; and, the trailing edge serpentine flow circuits both include four legs.

3. The turbine stator vane of claim 1, and further comprising:

the first legs of both of the leading edge serpentine flow circuits are formed as a single channel located adjacent to the impingement cooling air cavity.

4. The turbine stator vane of claim 1, and further comprising:

the leading edge serpentine flow circuits include legs that are parallel to the leading edge side of the endwall; and, the trailing edge serpentine flow circuits include legs that are parallel to the trailing edge side of the endwall.

5. The turbine stator vane of claim 1, and further comprising:

the last legs of the trailing edge serpentine flow circuits both are connected to a row of discharge holes extending along an entire length of the trailing edge side of the endwall.

6. The turbine stator vane of claim 5, and further comprising:

the serpentine flow circuits in the leading edge section and the mate face and the trailing edge section forms closed cooling air paths from inlet feed holes in the leading edge section of the endwall to the discharge cooling air holes along the trailing edge section of the endwall.

7. The turbine stator vane of claim 1, and further comprising:

the serpentine flow circuits in the leading edge section and the mate face and the trailing edge section form two ten-pass serpentine flow cooling circuits each with legs parallel to the leading edge side and trailing edge side of the endwall.

8. A process for cooling an endwall of a turbine stator vane, the vane including an endwall impingement cavity, the process comprising the steps of:

cooling a backside surface of the endwall with impingement cooling air;

collecting the impingement cooling air in the impingement cavity;

passing the cooling air from the impingement cavity along a serpentine flow path in a leading edge section of the endwall;

passing the cooling air from the leading edge section along both mate faces;

passing the cooling air from both mate faces along a serpentine flow path in a trailing edge section of the endwall; and, discharging the cooling air out from a side of the endwall on the trailing edge side.

9. The process for cooling an endwall of claim 8, and further comprising the step of:

passing all of the cooling air from the serpentine flow paths in the leading edge section to the serpentine flow paths in the trailing edge section.

10. The process for cooling an endwall of claim 8, and further comprising the step of:

passing the cooling air in the leading edge section and the trailing edge section in a direction parallel to the leading and trailing edge sections.

11. A turbine stator vane comprising:

an airfoil extending from an endwall;

the endwall having a leading edge section, a mate face section, and a trailing edge section;

an impingement cooling air cavity formed on a backside of the endwall;

a first serpentine flow cooling circuit formed in the leading edge section of the endwall;

a row of cooling air feed holes connecting the impingement cooling air cavity to the first serpentine flow cooling circuit;

a second serpentine flow cooling circuit formed in the trailing edge section of the endwall;

a mate face cooling channel connecting the first serpentine flow cooling circuit to the second serpentine flow cooling circuit; and, a row of discharge cooling holes formed in the trailing edge section of the endwall and connected to the second serpentine flow cooling circuit to discharge the cooling air.

12. The turbine stator vane of claim 11, and further comprising:

a last leg of the second serpentine flow cooling circuit opens onto the mate face to discharge a remainder of the cooling air flow.

13. The turbine stator vane of claim 11, and further comprising:

the first serpentine flow cooling circuit includes five legs; and, the second serpentine flow cooling circuit includes four legs.

* * * * *